United States Patent [19]

Patel

[11] Patent Number: 4,525,305

[45] Date of Patent: Jun. 25, 1985

[54] LEATHER WITH FLUOROCHEMICAL FINISH

[75] Inventor: Kalyanji U. Patel, Maplewood, Minn.

[73] Assignee: Minnesota Mining and Manufacturing Company, St. Paul, Minn.

[21] Appl. No.: 436,267

[22] Filed: Oct. 25, 1982

[51] Int. Cl.[3] ..... C11C 3/00; C14C 9/00; C14C 9/02; D06M 13/40

[52] U.S. Cl. ..... 260/401; 252/8.57; 252/8.75; 252/8.8; 260/402.5; 260/404; 260/404.5; 260/405; 260/408; 560/25; 560/26; 560/33; 560/115; 560/195; 562/439; 562/507; 562/560

[58] Field of Search ..... 260/404.5 F, 404, 408, 260/405, 402.5, 404.5 PA, 401; 560/25, 26, 33, 115, 195; 562/439, 507, 560

[56] References Cited

U.S. PATENT DOCUMENTS

| | | | |
|---|---|---|---|
| 2,934,450 | 4/1960 | Brown | 106/287 |
| 3,238,236 | 3/1966 | Hauptschein et al. | 260/408 |
| 3,382,097 | 5/1968 | Erby et al. | 117/141 |
| 3,471,518 | 10/1969 | Hager | 260/345.9 |
| 3,524,760 | 8/1970 | Pinkerton | 117/63 |
| 3,574,518 | 4/1971 | Detomaso | 8/94.21 |
| 3,651,105 | 3/1972 | Anello et al. | 260/414 |
| 3,657,320 | 4/1972 | Anello et al. | 260/471 C |
| 3,852,313 | 12/1974 | Beyleveld et al. | 260/404.5 |
| 3,907,576 | 9/1975 | Dear | 106/260 |
| 4,035,506 | 7/1977 | Lucas et al. | 260/408 X |
| 4,043,923 | 8/1977 | Loudas | 252/8.75 |
| 4,171,282 | 10/1979 | Mueller et al. | 252/8.57 X |
| 4,215,205 | 7/1980 | Landucci et al. | 560/25 X |
| 4,289,892 | 9/1981 | Soch | 560/26 |
| 4,302,366 | 11/1981 | Perronin et al. | 252/8.57 |
| 4,340,749 | 7/1982 | Patel | 560/25 X |

FOREIGN PATENT DOCUMENTS

| | | | |
|---|---|---|---|
| 1396008 | 3/1965 | France . | |
| 999795 | 7/1965 | United Kingdom | 560/25 |

OTHER PUBLICATIONS

Wagner, R. B. and Zook, H. D., *Synthetic Organic Chemistry*, John Wiley & Sons, Inc., New York, (1953) pp. 645 and 660.

Kirk-Othmer, Encycl. of Chem. Tech., vol. 22, 1970, John Wiley & Sons, pp. 150, 151.

Hopkins, W. J. et al., J. Amer. Leather Chem. Assn., 67, 552-4, (1972).

Grueber, A. L., Report No. 59, (1979) Wool Research Organisation of New Zealand, Inc.

Nagabhushanam, T. et al., Leather Science, 22, 229-234 (1975).

Kirk-Othmer, Encycl. of Chem. Tech., 3rd Ed., vol. 14, John Wiley & Sons, New York, 1981, pp. 200-224.

"Leather Facts", published by New England Tanners Club, 1965.

"Bayer Reports", English Edition of Bayer-Berichte, 45/1981, pp. 17-25.

*Primary Examiner*—Thomas A. Waltz

*Attorney, Agent, or Firm*—Donald M. Sell; James A. Smith; Carole Truesdale

[57] ABSTRACT

Fluorochemical aliphatic carboxylic acids, and water dispersible salts thereof, having fluoroaliphatic radicals and urylene and/or carbamato radicals, are used to impart oil and water repellency to fibrous substrates such as tanned leather.

10 Claims, No Drawings

LEATHER WITH FLUOROCHEMICAL FINISH

This invention relates to finishing tanned leather with fluorochemical compounds and to the so prepared finished leather. In another aspect, it relates to such fluorochemical compounds and to their preparation.

Leather has a combination of properties which has long made it useful and desirable for many applications requiring protection, comfort, durability, and esthetics, e.g. footwear, garments, and upholstery. Such properties include long term flexibility, toughness, breathability, insulation, conformability, and such esthetic properties as soft feel and luxurious appearance. However, due to its porous, fibrous structure, leather absorbs water and oil, and the consequent unsightly water spotting and stains detract from its usefulness and appearance. There has been considerable effort expended to overcome these drawbacks of leather. See Kirk-Othmer, Encycl. of Chem. Tech., Vol. 22, 1970, John Wiley & Sons, p. 150, 151.

Certain fluorochemicals have been proposed or used as means to impart water and oil repellency to leather. Those fluorochemicals disclosed in the patent literature include fluoropolymers of fluorinated acrylate monomers (U.S. Pat. No 3,524,760), fluorinated carboxylic acids (U.S. Pat. No. 3,382,097), perfluoroalkyl alkylene thiocarboxylic acids (U.S. Pat. No. 3,471,518), chromium complexes of fluorinated carboxylic acids(U.S. Pat. Nos. 2,934,450, 3,651,105, 3,907,576, and 3,574,518), and carbamates of fluorocarbon alcohols (U.S. Pat. No. 3,657,320). Those fluorochemicals disclosed in other literature include the chromium complex of a fluorinated carboxylic acid (Hopkins, W. J. et al., J. Amer. Leather Chem. Assn., 67 552–4 (1972)), fluoropolymers of fluorinated acrylate monomers (Grueber, A. L., Report No. 59 (1979), Wool Research Organization of New Zealand, Inc.), and perfluorobutyl acrylate, fluoroalkylsiloxane polymers, polyfluoroalkyl phosphates, and fluoro compounds (Nagabhushanam, T. et al., Leather Science, 22 229–234 (1975)).

Only a few of these prior art fluorochemicals have been found to be commercially useful in leather finishing, and even then, on a limited basis. For example, the chromium complexes, due to the green color they impart to the leather, are limited in use generally to the finishing of dark leather.

The fluorochemicals used in this invention confer durable water and oil repellency to leather while not adversely affecting the appearance, feel, hand, and other desirable qualities of the leather. And the fluorochemicals and their aqueous dispersions are generally colorless.

The fluorochemical compositions useful in the leather finishing process of this invention comprise fluorochemical compounds which are normally solid, water insoluble, fluoroaliphatic radical-containing and ureylene (—NHCONH—), carbamato(—OCONH—), carbonamido(—CONH—), and/or carbonyloxy(—OCO—)radical-containing aliphatic carboxylic acids, and the salts of said acids which are self-dispersible in water. (The term "aliphatic carboxylic acid" refers to an organic compound having a carboxyl group, —COOH, the carbon atom of which is bonded to a carbon atom which is part of an aliphatic moiety, e.g. —$CH_2$—, as distinguished from a ring carbon atom in an aromatic nucleus.)

The aforementioned three types of radicals or moieties—the fluoroaliphatic radical, the carboxylic acid group, and the four different carbonyl-containing radicals (i.e., the ureylene, carbamato, carbonamido, and/or carbonyloxy)—are covalently bonded together in the same molecule by organic linkages which are of a non-interfering nature (as described in detail below). Those three types of radicals or moieties and the organic linkages are the essential parts of the fluorochemicals of this invention. The number of each of them in a particular fluorochemical compound can vary, but generally such a compound will have one or two fluoroaliphatic radicals (commonly symbolized as "$R_f$"), one aliphatic carboxyl group, and 1 to 4 of said carbonyl-containing radicals ("A") of preferably no more than two types. Where the fluorochemical compound has only one carbonyl-containing radical, A, it will generally be a urylene or carbamato radical.

Those fluorochemical compounds of this invention with relatively low softening or melting points, e.g. less than 100° C., preferably less than 70° C., will generally impart better oil repellency to the tanned leather and are thus preferred.

A class of said fluorochemical compounds can be represented by the formula:

$$[R-Q-A-Q'-]_m(Q)_nCOOM \qquad \text{I}$$

where

R is a fluoroaliphatic radical ($R_f$) or an aliphatic radical ($R_h$),

Q is an organic linkage,

Q' is Q or Q—A—Q,

A is a carbonyl-containing radical selected from the group consisting of —NHCONH—, —CONH—, —OCO—, and —OCONH—, M is a hydrogen atom or an alkali metal, ammonium, or organoammonium ion, m is 1 or 2, with the provisos that if m is 1, then R is said $R_f$ and if m is 2, then at least one R is said $R_f$, and n is zero or 1.

Subclasses of fluorochemical compounds within the scope of formula I supra include those represented by formulas II, III, and IV below.

$$[R_f-Q-A-Q']_2QCOOM \qquad \text{II}$$

where $R_f$, Q, A, Q', and M are as defined for formula I, though A preferably is carbamato.

$$R_f-Q-A-Q'-COOM \qquad \text{III}$$

where $R_f$, Q, A, Q', and M are as defined for formula I, though A preferably is urylene carbamato and Q' contains said aliphatic radical $R_h$.

$$\begin{array}{l} R_f-Q-A-Q' \\ \qquad\qquad\quad \diagdown \\ \qquad\qquad\qquad Q-COOM \\ \qquad\qquad\quad \diagup \\ R_h-Q-A-Q' \end{array} \qquad \text{IV}$$

where $R_f$, Q, A, Q', and M defined for formula I, though A preferably is urylene or carbamato and $R_h$ is said aliphatic radical as defined for formula III.

The fluoroaliphatic radical ($R_f$) is a fluorinated, preferably saturated, monovalent, non-aromatic, aliphatic radical of at least three fully fluorinated carbon atoms. The chain in the radical may be straight, branched, or, if sufficiently large, cyclic, and may be interrupted by divalent oxygen atoms or trivalent nitrogen atoms bonded only to carbon atoms. A fully fluorinated aliphatic radical is preferred, but hydrogen or chlorine atoms may be present as substituents in the radical provided that not more than one atom of either is present in the radical for every two carbon atoms, and the radical must at least contain a terminal perfluoromethyl group. Preferably, the fluorinated aliphatic radical contains not more than 20 carbon atoms because such a large radical results in inefficient use of the fluorine content. The fluorochemicals preferably contain at least 20 weight percent, preferably 25 to 50 weight percent, fluorine in the form of said fluoroaliphatic radical.

The aliphatic radical ($R_h$) is an essentially fluorine-free radical preferably having at least 5 catenary carbon atoms and as many as 18 or even 24 such atoms. In a sense, it is the fluorine-free analog of the fluoroaliphatic radical, though it can be polyvalent or monovalent.

The organic linkages, Q, can have a wide variety of structures, serving as they do as the function of bonding together in the same molecule the R, A, and COOM moieties. However, the COOM moiety is bonded to an aliphatic carbon atom of the vicinal Q linkage, and the A moieties are bonded only to carbon atoms (aromatic or aliphatic) of the vicinal Q linkages. And, furthermore, the Q linkages must be free of interferring moieties, particularly hydrophilic groups, such as acidic functional groups and salts thereof, e.g. —COOH and —COONa, polyoxyethylene, polyethyleneimine, and aliphatic hydroxyl groups, which would interfere with the ability of the fluorochemical compound to impart the desired oil and water repellency to the substrate treated therewith in accordance with this invention. Bearing in mind the above-described function of the Qs and constraints thereon, Q can comprise such representative moieties as aliphatic moieties, e.g. $—CH_2—$, $—CH_2CH_2—$—$CH{=}CH—$, and cyclohexylene, aromatic moieties, e.g., phenylene, and combinations thereof, e.g. methylene diphenylene and tolylene, or combinations of such moieties with such hetero-atom-containing moieties as oxy, thio, aza, carbonyl, sulfone, sulfoxy, sulfonamido, carbonamido urylene carbamato, and imino, e.g. combinations such as sulfonamidoalkylene, carbonaminoalkylene, alkyleneoxyalkylene, iminoalkylene, alkylenecarbamato, and sulfonyloxyphenylene. The Qs for a specific fluorochemical compound useful in this invention will be dictated by the ease of preparation of such compound and the availability of the necessasry precursors thereof. From the above description of Q, it is apparent that these linkages can have a wide variety of structures. However large Q is, and regardless of how many Qs there are in such compounds, the fluorine content (the locus of which is $R_f$) of the compounds is at least 20 weight percent of the compounds.

In order for the fluorochemical compounds to disperse well in water, for example in the aqueous medium used in the wet end drumming treatment of tanned leather (after splitting and shaving in the case of cattlehide), the compounds are in the form of their water-dispersible salts, i.e., M in formula I is an alkali metal, ammonium, or organoammonium ion, e.g., Na, K, $NH_4$, $NH_2(C_2H_5)_2$, $HN(CH_3)_3$, $H_2N(C_2H_4OH)_2$, $HN(CH_3)_2C_2H_4OH$, and morpholinoammonium. Such salts are made by neutralizing the carboxylic acid precursor (i.e., compounds of formula I where M is H) with the appropriate aqueous base, e.g. ammonium hydroxide.

The fluorochemical compounds of this invention can be prepared by reacting selected organic reagents with fluoroaliphatic radical-containing intermediates (that is, precursors containing $R_f$, which generally are commercially made by electro-chemical fluorination of organic acids or halides thereof or by telomerization of tetrafluoroethylene, followed by known reactions to form said intermediates). Such reactions are carried out neat or in the presence of polar non-reactive solvents, such as ethyl acetate, at moderate temperatures, such as 50° to 130° C. Because of the nature of such intermediates and such reactions, the fluorochemicals so prepared and useful in this invention will often be mixtures of isomers and homologs.

Suitable $R_f$ precursors for this purpose include the following representative compounds:

$C_8F_{17}SO_2N(C_2H_5)C_2H_4OH$
$C_8F_{17}SO_2N(CH_3)C_4H_8OH$
$C_7F_{15}CH_2OH$
$C_6F_{13}CH_2CH_2OH$
$C_8F_{17}C_2H_4SC_2H_4OH$

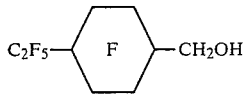

$(CF_3)_2CFOC_2F_4C_2H_4OH$
$C_6F_{13}C_2H_4SO_2N(CH_3)C_2H_4OH$
$C_7F_{15}CON(CH_3)C_2H_4OH$ $$C_3F_7(\underset{\substack{|\\ CF_3}}{CF}CF_2O)_2\underset{\substack{|\\ CF_3}}{CF}CH_2OH$$

$C_{10}F_{19}OC_6H_4SO_2N(CH_3)C_2H_4OH$
$C_8F_{17}C_2H_4N(CH_3)C_2H_4OH$
$C_8F_{17}SO_2N(CH_3)H$
$C_8F_{17}SO_2N(CH_3)C_2H_4OCOCH{=}CH_2$
$C_8F_{17}C_2H_4OCOCH{=}CH_2$
$C_8F_{17}SO_2F$
$C_9F_{19}CH_2NCO$
$C_8F_{17}SO_2NHC_2H_4NH_2$
$C_8F_{17}SO_2N(CH_3)C_2H_4OCH_2CH(OH)CH_2Cl$
$C_8F_{17}SO_3C_6H_4NCO$.

The organic reagents which are reacted with the appropriate $R_f$ precursors to prepare the fluorochemical treating agents of this invention include the following representative organic polyisocyanates:

tolylene-2,4-diisocyanate
hexamethylenediisocyanate
methylenebis(4-cyclohexylisocyanate)
methylenebis(4-phenylisocyanate)
1,3,3-trimethyl-5-isocyanatocyclohexyl-1-methylisocyanate
p-xylylenediisocyanate
2,2,5-trimethylhexyl-1,6-diisocyanate
dimethylenetriphenyltriisocyanate the following representative aliphatic dicarboxylic acid anhydrides:

succinic anhydride
glutaric anhydride
itaconic anhydride
maleic anhydride
azelaic polyanhydride the following representative hydroxy- or amino-substituted carboxylic acids:

$(HOCH_2)_2C(CH_3)COOH$
$C_6H_{13}CH(OH)(CH_2)_{10}COOH$
$C_6H_{13}CH(OH)CH_2CH{=}CH(CH_2)_7COOH$
$HO(CH_2)_5COOH$
$HO(CH_2)_3COOH$
$HO(CH_2)_2COOH$
$HOCH_2COOH$
$H_2NCH_2COOH$
$H_2N(CH_2)_3COOH$
$H_2N(CH_2)_{10}COOH$
$H_2N(CH_2)_5COOH$.

In general, the fluorochemical carboxylic acids having carbomato and/or urylene radicals can be prepared by reacting $R_f$-isocyanate with a hydroxy- or aminoaliphatic carboxylic acid. For the fluorochemical carboxylic acid having carbonyloxy radical, a $R_f$-containing electrophilic olefin can be reacted with an amino-aliphatic carboxylic acid. For the fluorochemical carboxylic acids having carbonamido or carbonyloxy radicals, a $R_f$-amine or $R_f$-alcohol can be reacted with an aliphatic carboxylic acid anhydride. The salts of the above-described three general types of fluorochemical aliphatic carboxylic acids can be prepared by neutralizing such acids with appropriate salt-forming bases. Where the fluorochemical product desirably has a monovalent aliphatic group, $R_h$, as in formula IV supra, an $R_h$-alcohol, -isocyanate, or -amine can be used in place of a portion of the corresponding $R_f$-precursor.

The preferred anionic fluorochemical urethane compounds used in this invention generally can be prepared by reacting a fluoroaliphatic alcohol (as an $R_f$ percursor) with a diisocyanate and the hydroxy-substituted carboxylic acid in appropriate molar ratios by refluxing the reactants in a polar, non-reactive organic solvent, such as ethyl acetate at a concentration of about 60 to 70 percent solids. An equivalent amount of an aqueous base is added to neutralize the acid function, the water used being sufficient to yield about a 20 to 25 weight percent aqueous dispersion of the fluorochemical carboxylate product (after distilling off the organic solvent).

Other fluorochemical compounds used in this invention can be prepared by known organic reactions, representative synthetic routes for some of these being outlined in the following reaction schemes, where $R_f$, Q, and m are as defined above, and $R^2$ comprises an aliphatic moiety having a carbon atom bonded to the depicted carboxylic radical.

Scheme 1

$$R_f{-}Q{-}OH + R(NCO)_2 \longrightarrow R_f{-}Q{-}OCONHRNCO\ (\text{"Z"})$$

$$m\text{"Z"} + (HOR^1)_mR^2COOH \longrightarrow [R_f{-}Q{-}OCONHRNHCOOR^1]_mR^2COOH$$

Scheme 2

$$\text{"Z"} + H_2NR^2COOH \longrightarrow R_f{-}Q{-}OCONHRNHCONHR^2COOH$$

Scheme 3

$$2\,R_f{-}Q{-}OCOCH{=}CH_2 + H_2N(CH_2)_nCOOH \longrightarrow (R_f{-}Q{-}OCOCH_2CH_2)_2N(CH_2)_nCOOH$$

Scheme 4

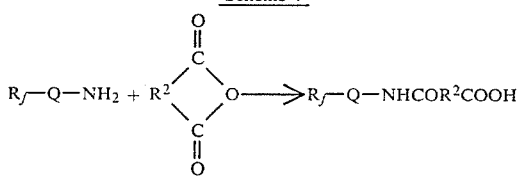

Scheme 5

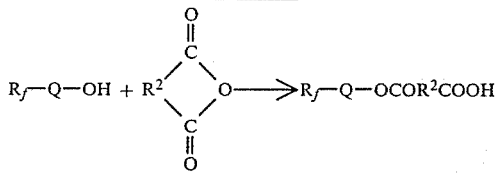

Scheme 6

$$R_f{-}Q{-}NCO + HOR^2COOH \longrightarrow R_f{-}Q{-}NHCOOR^2COOH$$

Representative fluorochemical compounds useful in the practice of this invention are those represented by the formulas (which are numbered for later reference) in Table 1. The fluorochemical compounds of formulas 1–12, 23, 25 can be made by following Scheme 1, those of formulas 13, 14, 15, 20, 22 by following Scheme 2, those of formulas 18, 19, 21 by following Scheme 6, and those of formulas 16, 24, 17 by following Schemes 3, 4, 5, respectively.

TABLE 1

| Formula No. | Structure of fluorochemical (FC) |
|---|---|
| 1. | 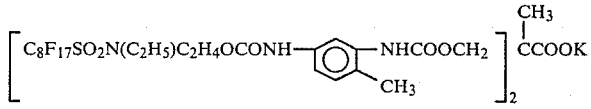 |
| 2. | 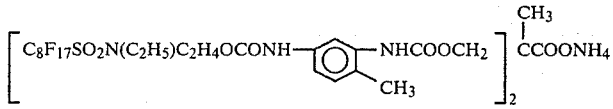 |
| 3. | 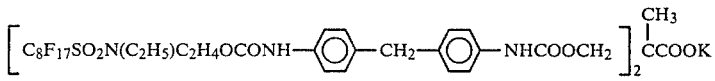 |

TABLE 1-continued
| Formula No. | Structure of fluorochemical (FC) |
|---|---|
| 4. | 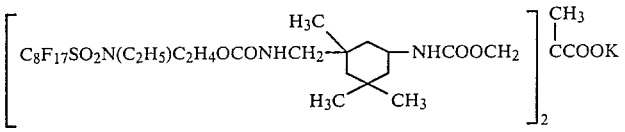 |
| 5. | 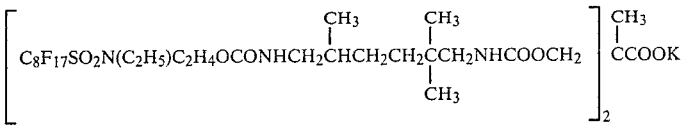 |
| 6. | 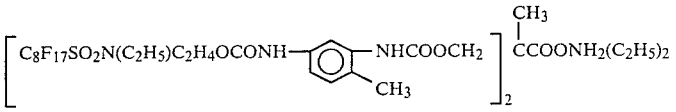 |
| 7. | 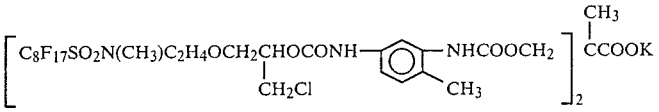 |
| 8. | 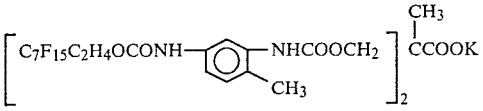 |
| 9. | 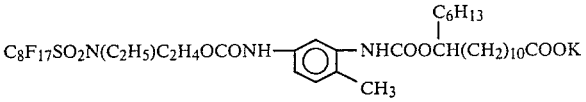 |
| 10. | 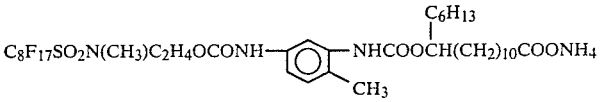 |
| 11. | 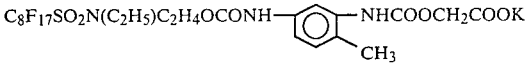 |
| 12. | 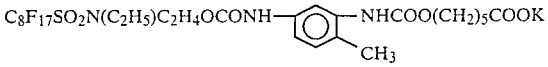 |
| 13. | 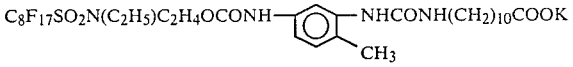 |
| 14. | 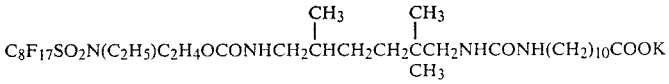 |
| 15. | 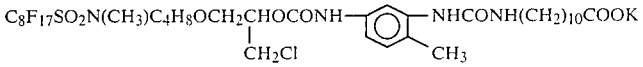 |
| 16. | $[C_8F_{17}SO_2N(CH_3)C_2H_4OCOCH_2CH_2]_2N(CH_2)_{10}COONH_4$ |
| 17. | $C_8F_{17}SO_2N(C_2H_5)C_2H_4OCOCH_2CH_2COOK$ |
| 18. | $C_7F_{15}CH_2NHCOOC(C_6H_{13})H(CH_2)_{10}COONH_4$ |
| 19. | $[C_7F_{15}CH_2NHCOOCH_2]_2C(CH_3)COOK$ |
| 20. | $C_7F_{15}CH_2NHCONH(CH_2)_{10}COONH_4$ |

TABLE 1-continued

| Formula No. | Structure of fluorochemical (FC) |
|---|---|
| 21. | $C_8F_{17}SO_3$–⟨benzene⟩–$NHCOO(CH_2)_3COONa$ |
| 22. | $C_8F_{17}SO_3$–⟨benzene⟩–$NHCONH(CH_2)_5COONH_4$ |
| 23. | $C_8F_{17}SO_2N(C_2H_5)C_2H_4OCONH$–⟨benzene⟩(–$CH_3$)–$NHCOOCH(C_6H_{13})CH_2CH{=}CH(CH_2)_7COOK$ |
| 24. | $C_8F_{17}SO_2NHC_2H_4NHCOC_3H_6COONH_4$ |
| 25. | $CH_3(CH_2)_{17}OCONH$–⟨benzene⟩(–$CH_3$)–$NHCOOCH_2$ and $C_8F_{17}SO_2N(C_2H_5)C_2H_4OCONH$–⟨benzene⟩(–$CH_3$)–$NHCOOCH_2$ bonded to C, $CH_3$, COOM |

Mixtures of the fluorochemical compounds can be used in this invention. In fact, where said Schemes 1 and 2 are used to prepare compounds 1, 2, 5, 6–15, 23, 25 isomers of those compounds will be present in admixture with them; in the case of compounds 1, 2, 6–13, 15, 23, 25 these compounds will be produced in admixture with isomers where the aromatic methyl substituent is in the 5-position of the ring; in the case of compounds 5 and 14, these compounds will be produced in admixture with isomers where the gem methyl groups on the hexylene chain are in the 5-position and the third methyl group is in the 2-position.

Since the fluorochemicals of this invention are preferably applied to tanned leather in conjunction with the wet processing thereof, the fluorochemicals are preferably used for this purpose in the form of their salts, such salts being self-dispersible in water. Thus, aqueous dispersions of such one or a mixture of such salts, with the concentration of the salts in the dispersion being such as to provide the appropriate treating level, can advantageously be added to the tanning drum commonly used in the wet processing of tanned leather. Such wet processing operation normally entails steps of re-tanning, dyeing, and fatliquoring, with water rinsing usually following these steps, the operation then being normally followed by dry operations. (For a review article on leather and its preparation, see for example Kirk-Othmer, Encycl. of Chem. Tech., 3rd Ed., Vol. 14, John Wiley & Sons, New York, 1981, pp. 200–224.) Advantageously, the fluorochemical treatment or finishing of leather in accordance with this invention can be carried out in conjunction with the normal post-tanning, wet processing operation without requiring significant alteration thereof other than accommodating addition of the aqueous fluorochemical dispersion (by itself or in admixture with any of the normal post-tanning agents,) to the wet processing drum. Preferably, the aqueous dispersion is added by itself to the aqueous medium-leather-containing drum before the fatliquoring step or after the fatliquoring step without draining the fatliquor-bath before addition of the dispersion. After allowing sufficient time for impregnation or penetration of the fluorochemical salt into the leather being tumbled in the drum, e.g. 20 minutes, the bath in the drum is acidified with an organic acid, such as formic acid, to a pH of about 4. Advantageously, fluorochemicals of this invention applied by this process are substantially completely exhausted from the fatliquor bath onto the tanned leather.

Other methods of applying or contacting tanned leather with the fluorochemicals of this invention can be used, such as spraying, brushing, or padding the tanned leather with an aqueous dispersion of the salt form of the fluorochemical or with an organic solvent solution of the acid form of the fluorochemical. For example, a 50% butoxyethoxyethyl acetate solution of the fluorochemical acid or its water-dispersible salt, e.g. ammonium salt, can be made up and further diluted with water to an appropriate treatment level and applied to the leather as a sprayable aqueous dispersion. If an organic solvent solution of the fluorochemical is to be applied, solvents such as chlorinated hydrocarbons, e.g. tetrachloroethylene and trichloroethylene, can be used to dissolve the fluorochemical acid.

The amount of the fluorochemical deposited on the tanned leather can vary, but functionally stated that amount will be sufficient to impart oil and water repellency to the leather. Generally that amount will be about 0.2 to 4, preferably 0.5 to 3, weight percent based on the weight of the tanned leather after it is dried at the temperatures, e.g. 40°–60° C., encountered in the normal drying operation of leather finishing. With such amounts of fluorochemical deposited on the tanned leather, the finished leather will have oil and water repellency that is durable, that is, the repellency will last a long time during active use of the article made from such finished leather, the fluorochemical penetrating to a significant depth into the leather. Such durable repellency is obtained without adversely affecting the appearance, feel, hand, flexibility, breathability, or other desirable properties of leather. And such desirable properties are obtained not only by treating tanned cattlehide in accordance with this invention but other tanned hides and skins, such as sheepskin and pigskin.

The tanned leather finished in accordance with this invention can be used to fabricate or manufacture in the customary way such leather articles as shoe uppers, garments, gloves, luggage, handbags, upholstery, and the like.

Though the fluorochemicals of this invention are especially useful in the treatment of tanned leather (a collagen type, porous matrix in sheet form), as illustrated herein, they can be used to treat other fibrous substrates to impart oil and water repellency thereto.

Objects and advantages of this invention are shown in the following examples, Examples 1–17 illustrating the preparation of various fluorochemicals of this invention and Examples 18–59 illustrating the use of various fluorochemicals in the treatment of leather.

EXAMPLE 1

In a 2-liter, 3-neck, borosilicate glass flask fitted with condenser, thermometer, stirrer, and electric heating mantle, were placed 1108 g (2.0 moles) N-ethyl(perfluorooctane)sulfonamidoethyl alcohol, 348 g (2.0 moles) tolylene-2,4-diisocyanate, 134 g (1.0 mole) finely pulverized 2,2-bis(hydroxymethyl) propionic acid, 0.9 g dibutyltindilaurate urethane catalyst, and 575 g ethyl acetate solvent. The resulting reaction mixture was stirred and refluxed at 80° C. for about 6 hours to complete the reaction, as indicated by attainment of a clear solution and absence of —NCO groups as measured by infared absorption analysis.

The resulting product solution contained the fluorochemical acid represented by formula 1A.

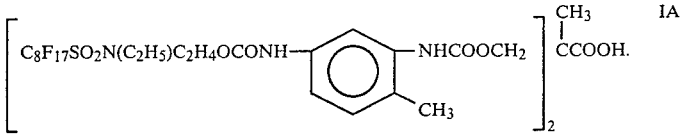

IA

About 33 percent of said product solution was placed in a 2-liter, 3-neck flask equipped as described above. To the flask were then added with stirring an aqueous KOH solution containing 0.33 mole base and 1700 g water. The flask was adapted for distillation and the contents heated to 80°–95° C. to remove ethyl acetate solvent. Water lost during this solvent removal process was replaced, resulting in a 25 weight percent solids aqueous dispersion of the fluorochemical acid potassium salt represented by formula 1 in Table 1 supra.

EXAMPLE 2

To about 33 percent of the ethyl acetate solution of the fluorochemical acid 1A of Example 1 in a 2-liter, 3-neck flask equipped as described above, there were added with stirring an aqueous solution containing 0.36 mole (a 10 percent excess) $NH_4OH$ and 1700 g water. The flask was adapted for distillation and the mixture heated to 80°–95° C. to remove ethyl acetate solvent. Water lost during this process was replaced, resulting in a 25 weight percent solids aqueous dispersion of the fluorochemical acid ammonium salt represented by formula 2 of Table 1 supra.

EXAMPLE 3–12

Following the general procedures of Examples 1 and 2 and using the appropriate or corresponding precursor fluorochemical alcohol, isocyanate, hydroxy carboxylic acid, and aqueous base, all in the appropriate molar ratios, there were prepared carbamate-ester-containing fluorochemical acid and acid salts represented by the formulas 3–12 of Table 1 supra.

EXAMPLE 13–15

A modification of the procedure of Example 1 can be used to prepare the fluorochemical compounds of formulas 13–15 of Table 1 supra, which contain urylene link in addition to the carbamato moiety.

In the preparation of these compounds, the fluorochemical alcohol is first prereacted (by reflux at 80° C. for two to four hours), with the diisocyanate to react one of the —NCO groups (mainly the position 4 —NCO function, in the case of tolylene-2,4-diisocyanate), then the reaction mixture is cooled to 35°–40° C., and the powdered amino acid is added and reflux and stirring continued for about two hours to yield the acid adduct. Aqueous base addition and solvent removal is carried out as described in Examples 1 and 2 to yield the salts, if they are desired.

Alternatively, all the organic reagents can be reacted together, as in Example 1.

Thus the compounds represented by formulas 13–15 were prepared using 10-aminoundecanoic acid as the amino acid reagent.

EXAMPLE 16

In a 250-ml flask (equipped as described in Example 1) were placed 132 g (0.2 mole) N-methyl(perfluorooctane)sulfonamidoethyl acrylate, 20 g (0.1 mole) 10-aminoundecanoic acid, and 50 g isopropyl alcohol. The resulting mixture was stirred and refluxed for 6 hours, allowed to cool overnight, and the flask adapted for distillation and heated to 80°–90° C. to remove most of the solvent. The fluorochemical acid product, which solidified on cooling, is represented by the following formula:

$$[C_8F_{17}SO_2N(CH_3)C_2H_4OCOC_2H_4]_2N(CH_2)_{10}COOH \qquad 16A.$$

Salts of the above-described product, such as the ammonium salt, are prepared by dissolving the desired quantity of the fluorochemical acid in a minimum amount of acetone and adding a slight molar excess of aqueous ammonium hydroxide. Such a salt is represented by the formula 16, Table 1 supra.

EXAMPLE 17

In a 250-ml flask (equipped as described in Example 1) were placed 55.4 g (0.1 mole) N-ethyl(perfluorooctane)sulfonamidoethyl alcohol, 10 g (0.1 mole) succinic anhydride, 17 g dimethylformamide solvent, and 0.3 g zinc chloride catalyst. The resulting mixture was stirred and heated at 120°–125° C. for 1.5 hours, then at about 150° C. for an additional 2 hours. The resulting reaction mixture was cooled and aqueous KOH solution containing 0.1 mole of base was added. The solution contained a salt product represented by the formula 17, Table 1 supra.

The aqueous mixture containing the salt was dissolved in a mixture of 70 parts by weight water and 30 parts by weight isopropyl alcohol to yield a 10 weight percent solution of the salt, which was extracted with $CF_2ClCFCl_2$ to remove any unreacted fluorochemical alcohol starting material.

EXAMPLE 18–40

In these examples, samples of chrome tanned leather were treated with various fluorochemical compositions in accordance with this invention and the properties of the treated leather tested. For comparison, similar treatments were made on other samples using fluorochemicals outside the scope of this invention or on a sample without use of any fluorochemical.

The size of each tanned leather sample was about 20 g. with a thickness of 2 to 3 mm. The samples were both received and stored wet until their treatment and evaluation.

The apparatus used for treating the tanned leather samples comprised a roller mill with a variable speed for rotating the treating drums, each drum being 30 cm in diameter, 11.5 cm in length, and made of polymethylmethacrylate (1 cm thickness), the drum having a drain hole and a loading hole, which holes were closed with rubber stoppers during use. Heating of the drum contents was performed by means of infrared lamps placed about 10 cm away from the wall of the drum. Temperature during treatment was maintained about 45° C. except for the final rinsing step. During treatment, the drums were rotated at about 20 to 25 rpm.

For each treatment, the leather sample was placed in the drum along with several rubber stoppers to provide agitation and flexing of the leather sample during treatment.

In addition to the fluorochemical composition used in treating the leather samples, various other leather treating chemicals were used: in most runs, a fatliquor, dye, and neutralizing agent were used.

In treating the various leather samples, the following steps were used, and though the sequence given below is preferred (its the sequence normally used in the post-tanning of cattlehide, with step "f" omitted), the sequence of steps sometimes was altered in the examples and some of the steps sometimes were omitted:

TABLE 2

| No. | Step |
|---|---|
| a. | washing |
| b. | neutralizing |
| c. | retanning |
| d. | dyeing |
| e. | fatliquoring |
| f. | fluorochemical treatment |
| g. | rinsing |
| h. | drying |

Steps "a" through "f" were generally carried out in the rotating drum in the sequence listed in Table 2. In Examples 18, 30, 32, the sequence of steps e and f were reversed; and in Examples 19, 20, 21, 16, 31, 34, step e was omitted. In Examples 20, 21, 30, 32, the retanning step was used, and in Examples 20, 21 the dyeing step was omitted. In some cases, a treating agent was poured from the drum after its use, i.e., discarded, and in other cases it was allowed to remain in the drum, i.e., retained.

In the washing step, the leather was washed using an amount of water about 5 times (i.e., "500%") the weight of the leather sample. Washing was carried out for about 30 minutes at 25° C. and the used wash water having a pH of about 2.5 to 3.0 was discarded.

In the neutralizing step, an aqueous solution of one or more neutralizing agents was added to the drum in an amount of about 3 times the weight of the leather sample, the drum then rotating for about 45 minutes at about 40° C. to bring the pH of the bath to 4.5 to 5.0. The used neutralizing bath was discarded and the neutralized leather sample then rinsed for about 10 minutes with an amount of water of about 5 times the weight of the leather sample. The neutralizing agents used were those in the following table, where they are numbered for later reference.

TABLE 3

| No. | Name |
|---|---|
| 1 | ammonium sulfate |
| 2 | sodium bicarbonate |
| 3 | sodium formate |
| 4 | ammonium hydroxide |

Where a retanning step was used in the procedure, the retanning agent was "Baykanol Pak", and it was added during the neutralizing step.

In the dyeing step, the following amounts were added successively to the drum with the treatment times as indicated:

1. water (equal to the weight of the leather sample) containing 9.1 weight percent $NH_4OH$ (5 min.)
2. a brown acid dye "Dermabrown" RB, in an amount 0.02 times the weight of the leather sample (10 min.)
3. water, in an amount 3 times the weight of the leather sample (15 min.)
4. formic acid (about 1 ml of 9 weight percent aqueous solution) was added to acidify the bath to a pH of about 4.5 (15 min.)

The aqueous dye bath was discarded after the dyeing step.

In some examples where a fatliquoring step was used, a mixture of fatliquor (0.08 to 0.1 times the weight of the leather sample) and water (3 times the weight of the leather sample) was added to the drum and the leather sample treated for about 45 minutes therewith, the aqueous fatliquor bath being retained. The fatliquor used was a mixture of equal amounts of "Coripol" DXF chlorinated fatty acid and "Coripol" BZN lanolin based, non-penetrating oil.

In the fluorochemical treatment or finishing step, an aqueous dispersion of about 20 weight percent of fluorochemical was added to the bath, the amount of fluorochemical agent being about 0.02 times the weight of the leather sample, and the treatment with fluorochemical carried out for about 20 minutes, afterwhich the bath was acidified with formic acid to a pH of about 4. The fluorochemical-fatliquor bath was discarded unless the fluorochemical treatment step preceeded the fatliquor treatment step, in which case the bath was retained; also, water in the amount of 3 times the weight of the leather samples was added with the fluorochemical agent and a minimum amount of water added with the fatliquor if the fluorochemical treatment step preceeded the fatliquor treatment step.

Upon adding the aqueous dispersion of the fluorochemical to the aqueous medium in the drum, the aqueous bath became turbid. Over the 20-minute treatment period, the bath became almost clear. Upon acidifying the bath to pH 4 with the formic acid, the bath became clear, indicating essentially complete exhaustion of the fluorochemical onto the leather.

In the rinsing step, water in the amount of 10 times the weight of the leather sample was added, the fluorochemical treated leather washed therewith, and the water then discarded.

In the drying step, the fluorochemical treated, wet leather samples were stretched on a frame, dried in air at room temperature over-night, dried for about 1 hour at 60° C. in a forced-air oven, and the samples removed from the frames when they cooled to room temperature.

The dried, fluorochemical treated leather samples were tested generally on both the grain (hair) side and the suede (flesh) side for oil and water repellency.

In testing the fluorochemical treated leather sample for oil repellency (OR), AATCC Standard Test 118–1978 was used, which test is based on the resistance of treated fibrous substrates to penetration by oils of varying surface tensions. Treated leather samples resistant only to "Nujol" mineral oil (the least penetrating of the test oils) are given a rating of "1", whereas treated leather samples resistant to heptane (the most penetrating of the test oils) are given a value of "8". Other intermediate values are determined by use of other pure oils or mixtures of oils. The rated oil repellency corresponds to the most penetrating oil (or mixture of oils) which does not penetrate or wet the leather after 30 seconds contact. Higher numbers indicate better oil repellency. In general, an oil repellency of "2" or greater is desirable.

The aqueous stain repellency (WR) of the treated leather samples was measured using a water/isopropyl alcohol test, and the repellency is expressed in terms of a rating ratio. Treated leather samples which are penetrated by or resistant only to a 100 percent water/0 percent isopropyl alcohol mixture, the least penetrating of the test mixtures, are given a rating of "100/0", whereas treated samples resistant to a 0 percent water/100 percent isopropyl alcohol mixture, the most penetrating of the test mixtures, are given a rating of "0/100". Other intermediate values are determined by use of other water/isopropyl alcohol mixtures, in which the percentage amounts of water and isopropyl aocohol are each multiples of 10. The water repellency rating corresponds to the most penetrating mixture which does not penetrate or wet the leather after 30 seconds contact. In general a water repellency rating of "90/10" or better (e.g., 80/20 or 70/30, etc.) is desirable.

The water repellency (SR) of fluorochemical treated leather samples was measured by Standard Test Number 22, published in the 1977 Technical Manual and Yearbook of the American Association of Textile Chemists and Colorists (AATCC), and is expressed in terms of the water "spray rating" of the tested sample. The spray rating is measured using a 0 to 100 scale, where "100" is the highest possible rating. In general, a spray rating of "70" or greater is desirable, particularly for outerwear apparel, for example, leather coats or jackets.

In testing fluorochemical treated leather samples for water penetration (P), the extent of penetration of the fluorochemical treating agent into the leather was determined by measuring resistance of a cut surface of the treated leather sample to wicking or absorption of a water droplet placed on the cut surface. The leather sample is cut with a razor blade through about 75 percent of its thickness and the leather sample bent so that the cut surface forms a flat horizontal surface on which the water droplet is placed. The treated leather is visually rated with the unaided eye about 5 seconds after the water droplet is placed and is evaluated as follows:

"3" is a rating for complete water resistance or non-wicking, indicated by the water droplet remaining substantially in the form of a bead on the cut surface of the leather;

"2" is a rating for partial wicking, indicated by partial dissipation of the water droplet into a portion of the undyed region of the leather; and "1" is a rating for complete wicking of the water droplet by the cut leather surface, indicated by substantially complete dissipation of the water droplet into the leather up to the dyed region of the leather.

(A value of 3 is desired for leather to be used in shoe-uppers.)

Table 4 summarizes the examples.

TABLE 4

| | Treatment of Chrome-Tanned Leather | | | | | | | | | | |
|---|---|---|---|---|---|---|---|---|---|---|---|
| | Conditions | | | | Properties of treated samples | | | | | | |
| | | | | | Grain side | | | Suede side | | | |
| Ex. No. | FC used[a] | % SOF[b] | Neutralizer used[d] | Fat liquor used? | OR | WR | SR | OR | WR | SR | P |
| 18 | 1 | 1.9 | 2,3 | yes | 3 | 80/20 | 80 | 3 | 60/40 | 90 | 1 |
| 19 | 1 | 2.0 | 1 | no | 0 | 80/20 | | 6 | 30/70 | | 1 |
| 20 | 2 | 2.0 | 1 | no | 1 | 80/20 | 50 | 3 | 80/20 | 80 | 2 |
| 21 | 2 | 2.0 | 1 | no | 1 | 80/20 | 70 | 4 | 80/20 | 80 | 2 |
| 22 | 3 | 2.2 | 1,2 | yes | 1 | 90/10 | | 2 | 70/30 | 70 | 2 |
| 23 | 4 | 2.2 | 1,2 | yes | 3 | 80/20 | | 3 | 80/20 | 80 | 2 |
| 24 | 5 | 2.3 | 1,2 | yes | 3 | 90/10 | 70 | 5 | 80/20 | 70 | 2 |
| 25 | [c] | 1.6 | 1,2 | yes | 1 | 80/20 | | 3 | 70/30 | 80 | 1 |
| 26 | 7 | 2.6 | 1 | no | 0 | 60/40 | 50 | 5 | 20/80 | 80 | 1 |
| 27 | 8 | 2.0 | 1,2 | yes | 3 | 80/20 | | 3 | 90/10 | 70 | 1 |
| 28 | 16 | 1.6 | 1,2 | yes | 3 | 70/30 | | 4 | 70/30 | 70 | 1 |
| 29 | 17 | 2.5 | 1,2 | yes | 3 | 80/20 | | 4 | 60/40 | 80 | 3 |
| 30 | 9 | 0.8 | 1 | yes | 3 | 80/20 | 80 | 3 | 70/30 | 80 | 1 |
| 31 | 9 | 2.5 | 1 | no | 3 | 80/20 | 70 | 5 | 30/70 | 90 | 2 |
| 32 | 10 | 0.8 | 1 | yes | 3 | 60/40 | 80 | 4 | 50/50 | 90 | 1 |
| 33 | 10 | 1.1 | 1,2 | yes | 3 | 70/30 | 70 | 3 | 70/30 | 80 | 1 |
| 34 | 11 | 1.2 | 1 | no | 1 | 80/20 | | 2 | 30/70 | | 2 |
| 35 | 12 | 3.0 | 1,2 | yes | 3 | 70/30 | | 4 | 70/30 | 80 | 2 |
| 36 | 13 | 2.3 | 1,2 | yes | 0 | 90/10 | 50 | 0 | 80/20 | 70 | 1 |
| 37 | 14 | 2.0 | 1,2 | yes | 3 | 80/20 | | 5 | 80/20 | 70 | 2 |
| 38 | 15 | 1.8 | 1,2 | yes | 3 | 70/30 | | 3 | 80/20 | 70 | 1 |
| 39 | 23 | 2.0 | 1,2 | yes | 3 | 90/10 | | 5 | 70/30 | 30 | 3 |
| 40 | 24 | 2.2 | 1,2 | yes | 3 | 80/20 | | 3 | 80/20 | 70 | |

TABLE 4-continued

| Ex. No. | FC used[a] | % SOF[b] | Neutralizer used[d] | Fat liquor used? | Grain side OR | Grain side WR | Grain side SR | Suede side OR | Suede side WR | Suede side SR | P |
|---|---|---|---|---|---|---|---|---|---|---|---|
| | Treatment of Chrome-Tanned Leather | | | | | | | | | | |
| | Conditions | | | | Properties of treated samples | | | | | | |
| C-1 | | 1.9 | 1,2 | yes | 0 | 100/0 | | 0 | 100/0 | 70 | 2 |
| C-2 | | 2.0 | 1,2 | yes | 0 | 80/20 | | 0 | 80/20 | 70 | 1 |
| C-3 | | 1.9 | 1 | yes | 0 | 90/10 | 70 | 0 | 90/10 | 70 | 1 |
| C-4 | | 2.1 | 1 | yes | 1 | 90/10 | 70 | 3 | 80/20 | 80 | 3 |
| C-5 | | 2.0 | 1,2 | yes | 0 | 90/10 | | 3 | 80/20 | 70 | 1 |
| C-6 | None | 0 | 2,3 | yes | 0 | 100/0 | 0 | 0 | NWR[e] | 0 | |

[a]The indicated number of FC (fluorochemical) used corresponds to the formula number of Table 1. For the comparison examples, C-1 through C-5, the fluorochemicals used were:

C-1 $C_7F_{15}CONH(CH_2)_{10}COONH_4$

C-2 $C_8F_{17}C_2H_4SCH(COONH_4)CH_2COONH_4$

C-3 $C_8F_{17}SO_2N(C_2H_5)CH_2COOH$.chrome complex

C-4 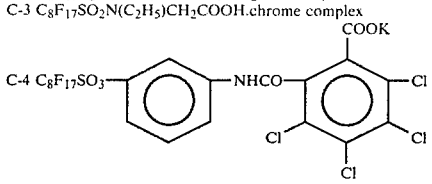

C-5 $C_9F_{19}CONHCH_2COONH_4$.

[b]"% SOF" is the level of FC in the treating bath and it is based upon the weight of the tanned leather sample (dry basis) used.

[c]The FC used in Example 25 was the product prepared as described in Examples 3–12 and was a mixture of the FC of formulas 1, 25, and

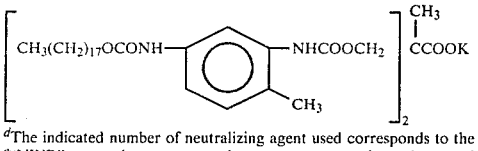

[d]The indicated number of neutralizing agent used corresponds to the number in Table 3.

[e]"NWR" means there was no resistance to water, as shown by complete penetration of the water droplet into the leather in less than 15 seconds after placement of the water droplet.

As the data in Table 4 show, the properties of the leather samples treated in accordance with this invention, that is, Examples 18–40, are generally good, especially when compared with the comparative examples, Examples C-1 to C-6. These good properties were obtained notwithstanding changes (in Examples 18–21, 26, 30–32, 34) in the normal sequence of wet processing steps and the omission of some commonly used post-tanning agents. However, better oil repellency on the grain side was obtained when the fatliquoring step was not omitted (cf. Example 18 vis-a-vis Example 19); thus, the practice of this invention is preferably used in conjunction with fatliquoring, a conventional post-tanning step in the leather industry. And better oil repellency on the grain and suede sides, and better water repellency on the grain side, are obtained with the low softening point fluorochemicals (cf. Example 36 vis-a-vis Example 38, the softening points (measured in a capillary tube) for the fluorochemicals used in Examples 36, 38 being >200° C. and about 30° C., respectively).

EXAMPLE 41–52

Following the general procedure of Examples 18–40, various tanned leathers were treated with two different fluorochemicals of this invention. However, if a particular leather sample to be treated with the fluorochemical had already been subjected to a standard leather processing step, that step was omitted. Also, none of the samples were treated with a retanning agent.

The types of leather samples used are shown in Table 5

TABLE 5

| No. | Type |
|---|---|
| A | chrome-crust cowhide |
| B | dyed, fatliquored cowhide |
| C | chrome-crust cowhide suede split |
| D | vegetable-tanned cowhide |
| E | dyed, fatliquored pigskin |
| F | tanned sheepskin, wool-on (tanned woolly sheepskin) |

The size of each tanned leather sample was about 20 g. with a thickness of 2 to 3 mm. The samples were both received and stored wet until their treatment and evaluation.

Table 6 summarizes the examples.

TABLE 6

| Ex. No. | FC used | Type leather used[a] | % SOF | Grain side OR | Grain side WR | Grain side SR | Suede side OR | Suede side WR | Suede side SR | P |
|---|---|---|---|---|---|---|---|---|---|---|
| | Treatment of Various Types of Leather | | | | | | | | | |
| | Conditions | | | Properties of treated leather | | | | | | |
| 41 | 1 | A | 2.1 | 3 | 70/30 | 80 | 4 | 70/30 | 80 | 1 |
| 42 | 1 | B | 2.2 | 3 | 80/20 | 50 | 4 | 60/40 | 80 | 2 |
| 43 | 1 | C | 1.6 | 3 | 70/30 | 80 | 3 | 70/30 | 80 | 2 |
| 44 | 1 | D | 1.0 | 3 | 80/20 | | 4 | 60/40 | | |
| 45 | 1 | E | 1.5 | 0 | 100/0 | 70 | 0 | 80/20 | 80 | 1 |

TABLE 6-continued

| Ex. No. | Conditions: FC used | Type leather used[a] | % SOF | Grain side OR | Grain side WR | Grain side SR | Suede side OR | Suede side WR | Suede side SR | P |
|---|---|---|---|---|---|---|---|---|---|---|
| 46 | 1 | F | 1.6 | 3 | 70/30 | | 3 | 70/30 | 80 | 1 |
| 47 | 10 | A | 2.0 | 3 | 80/20 | 70 | 5 | 30/70 | 90 | 1 |
| 48 | 10 | B | 2.3 | 3 | 80/20 | 70 | 5 | 40/60 | 80 | 2 |
| 49 | 10 | C | 1.6 | 5 | 40/60 | 100 | 4 | 50/50 | 100 | 1 |
| 50 | 10 | D | 1.0 | 1 | 90/10 | | 5 | 60/40 | | |
| 51 | 10 | E | 1.6 | 0 | 100/0 | 80 | 3 | 70/30 | 90 | 2 |
| 52 | 10 | F | 1.5 | 5 | 60/40 | | 5 | 30/70 | 80 | 2 |

Treatment of Various Types of Leather — Properties of treated leather

[a]The indicated letter of leather used corresponds to that described in Table 5.

As shown by Table 6, the water and oil repellency properties were generally good except for the grain side of the pigskin (leather E, Examples 45 and 51) in this series of examples.

EXAMPLES 53–57

A number of samples of chrome-tanned leather (Type A in Table 5) were treated with blends of fluorochemicals (FC) denoted by formula numbers 1 and 10 of Table 1, and, for comparison, such leather was treated with just one of these fluorochemicals. The neutralizer used was a mixture of ammonium sulfate and sodium bicarbonate, the dye used was "Dermabrown" RB (a brown acid dye), the fatliquors used were "Coripol" DXF and "Coripol" BZN, and the treatment steps and sequence were those of Table 2 except that the retanning step c was omitted. Properties of the resulting treated leather samples were determined as in the previous examples, along with the water absorption (WA) of the treated samples. The water absorption was determined on a "Bally" penetrometer, Model 5022, (a dynamic testing machine for shoe leather uppers). The WA values represent the increase in weight of the treated samples after 3 hrs. of repeated flexing of the samples during immersion of the grain side in water. The lower the value is, the greater the water repellency of the treated sample. Results are summarized in Table 7.

TABLE 7

| Ex. No. | Relative amount (parts) of FC used: FC-1 | FC-10 | Grain side OR | Grain side WR | Grain side SR | WA | Suede side OR | Suede side WR | Suede side SR | P |
|---|---|---|---|---|---|---|---|---|---|---|
| 53 | 100 | 0 | 3 | 80/20 | 50 | 61.0% | 3 | 80/20 | 70 | 2 |
| 54 | 75 | 25 | 3 | 80/20 | 70 | 48.4 | 4 | 70/30 | 80 | 2 |
| 55 | 50 | 50 | 3 | 70/30 | 70 | 51.4 | 5 | 60/40 | 80 | 2 |
| 56 | 25 | 75 | 3 | 70/30 | 80 | 17.2 | 5 | 60/40 | 90 | 3 |
| 57 | 0 | 100 | 3 | 70/30 | 80 | 16.6 | 5 | 40/60 | 90 | 2 |

Properties of treated samples

The data of Table 7 show generally good overall properties were obtained, and that for some particularly desired properties, a mixture of the fluorochemicals may be used rather than a single fluorochemical.

EXAMPLES 58 and 59

Following the general procedure of Examples 18–40, samples of sheepskin (wool-on), Type F of Table 3, were treated with two fluorochemicals of this invention, viz., those of formulas 1 and 10 of Table 1, the amounts of each deposited on the sheepskin being 1 wt% of the treated sample. These examples and results are shown in Table 8.

TABLE 8

| Ex. No. | FC used | Suede side: Before abrasion[a] OR | Before abrasion[a] WR | After abrasion[a] OR | After abrasion[a] WR | After abrasion[a] SR | Wool side OR | Wool side WR |
|---|---|---|---|---|---|---|---|---|
| 58 | 1 | 3 | 90/10 | 3 | 50/50 | 80 | 1 | 70/30 |
| 59 | 10 | 4 | 50/50 | 5 | 40/60 | 80 | 4 | 70/30 |

Treatment of Sheepskin (Wool-on) — Properties of treated samples

[a]Values given were obtained by rubbing the treated side with a "Scotchbrite" scouring pad for about 1 minute before measuring the indicated property.

The data of Table 8 show that desirable oil and water repellency can be obtained on sheepskin (with wool on) even at low fluorochemical levels.

Various modifications and alterations of this invention will be apparent to those skilled in the art without departing from the scope and spirit of this invention.

What is claimed is:

1. Compositions useful for imparting oil and water repellency to fibrous substrates when said substrates are contacted with said compositions, said compositions comprising fluorochemical compounds which are normally solid, water insoluble, aliphatic carboxylic acids and salts thereof which are self-dispersible in water, said compounds containing fluoroaliphatic and aliphatic carboxylic radicals, said fluoroaliphatic radicals having at least three fully fluorinated carbon atoms and a terminal perfluoromethyl group, and urylene and/or carbamato radicals, said radicals bonded together by organic linkages free of interfering moieties, said compounds containing at least 20 weight percent fluorine in the form of said fluoroaliphatic radical.

2. The compounds of claim 1 represented by the formula $$(R—Q—A—Q'—)_m(Q)_nCOOM$$

where

R is said fluoroaliphatic radical or an aliphatic radical which is essentially fluorine-free, Q is said organic linkage, Q′ is Q or Q—A—Q, each A is independently —NHCONH— or —OCONH—, M is a hydrogen atom or an alkali metal, ammonium, or organoammonium ion, m is 1 or 2, with the provisos that if m is 1, R is said fluoroaliphatic radical, and if m is 2, at least one of the two R radicals is a fluoroaliphatic radical, n is zero or 1 with the proviso that when n is zero, m is 1, and said compounds contain at least 20 weight percent fluorine in the form of said fluoroaliphatic radical.

3. The compounds of claim 1 represented by the formula $$(R_f\text{—Q—A—Q}')_2\text{QCOOM}$$

where $R_f$ is said fluoroaliphatic radical, each A is independently —NHCONH— or —OCONH—, and M is a hydrogen atom or an alkali metal, ammonium, or organoammonium ion, Q is said organic linkage, Q′ is Q—A—Q, and said compounds contain at least 20 weight percent fluorine in the form of said fluoroaliphatic radical.

4. The compounds of claim 1 represented by the formula $$R_f\text{—Q—A—Q}'\text{—COOM}$$

where $R_f$ is said fluoroaliphatic radical, each A is independently —NHCONH—([, —CONH—, —OCO—, ] or —OCONH—, M is a hydrogen atom or an alkali metal, ammonium, or organoammonium ion, Q is said organic linkage, Q′ is Q—A—Q, and said compounds contain at least 20 weight percent fluorine in the form of said fluoroaliphatic radical.

5. The compounds of claim 1 represented by the formula

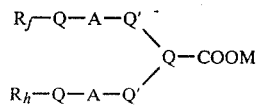

where $R_f$ is said fluoroaliphatic radical, $R_h$ is an aliphatic radical which is essentially fluorine free, Q is said organic linkage, each A is independently —NHCONH— or —OCONH—, Q′ is Q—A—Q, M is a hydrogen atom or an alkali metal, ammonium, or organoammonium ion, and said compounds contain at least 20 weight percent fluorine in the form of said fluoroaliphatic radical.

6. A compound of claim 1 having the formula

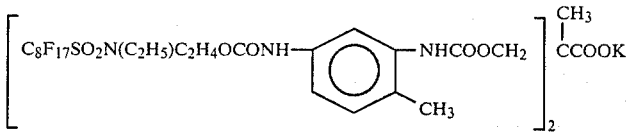

7. A fluorochemical compound which is normally solid, water insoluble, self-dispersible in water, said compound containing fluoroaliphatic and aliphatic carboxylic radicals and urylene and/or carbamato radicals, said radicals bonded together by organic linkages, and said compound having the formula

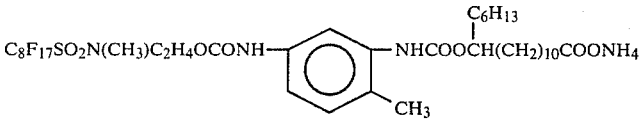

8. The compounds of claim 3 wherein A is —OCONH—.

9. The compounds of claim 4 wherein A is —OCONH—.

10. The compounds of claim 5 wherein A is —OCONH—.

* * * * *

UNITED STATES PATENT AND TRADEMARK OFFICE

CERTIFICATE OF CORRECTION

PATENT NO. : 4,525,305

DATED : June 25, 1985

INVENTOR(S) : Kalyanji U. Patel

It is certified that error appears in the above-identified patent and that said Letters Patent is hereby corrected as shown below:

Col. 1, line 59, delete "ureylene" and insert --urylene--;

Col. 2, line 4, delete "ureylene" and insert --urylene--;

Col. 2, line 54, after "urylene", insert --or--;

Col. 3, line 44, after "carbonamido" insert a comma, after "urylene" insert a comma;

Col. 7, Formula No. 14, delete the formula and insert $$--C_8F_{17}SO_2N(C_2H_5)C_2H_4OCONHCH_2\overset{CH_3}{\overset{|}{C}}HCH_2CH_2\underset{CH_3}{\underset{|}{\overset{CH_3}{\overset{|}{C}}}}CH_2NHCONH(CH_2)_{10}COOK--;$$

Col. 15, line 42, delete "aocohol" and insert --alcohol--;

Col. 21, lines 50-51, delete "([, -CONH-, -OCO-,]".

Signed and Sealed this

*Thirty-first* Day of *December 1985*

[SEAL]

*Attest:*

DONALD J. QUIGG

*Attesting Officer*

*Commissioner of Patents and Trademarks*